US005583392A

United States Patent [19]

Wada et al.

[11] Patent Number: 5,583,392

[45] Date of Patent: Dec. 10, 1996

[54] CRT ANODE CAP

[75] Inventors: Kazuo Wada; Hironobu Tokuno; Toshita Chihara, all of Kanagawa, Japan

[73] Assignee: Taisho Denki Kogyo Kabushiki Kaisha, Tokyo, Japan

[21] Appl. No.: 401,755

[22] Filed: Mar. 9, 1995

[30] Foreign Application Priority Data

Mar. 15, 1994 [JP] Japan ..... 6-044006

[51] Int. Cl.[6] ..... H01J 29/92; H01R 4/50

[52] U.S. Cl. ..... 313/477 HC; 313/51; 439/607; 439/834; 439/909

[58] Field of Search ..... 313/477 HC, 477 R, 313/49, 50, 51; 439/607, 834, 909

[56] References Cited

U.S. PATENT DOCUMENTS 4,326,096 4/1982 Leitmann ..... 313/477 HC 4,422,707 12/1983 Wada et al. ..... 439/607

FOREIGN PATENT DOCUMENTS 2636172 3/1990 France .

8702252 6/1987 Germany .

246660 2/1926 United Kingdom .

*Primary Examiner*—Nimeshkumar Patel

*Attorney, Agent, or Firm*—Jordan and Hamburg

[57] ABSTRACT

An anode structure allows firmly connecting thereto a core conductor of a high-voltage supply lead without using any pressing tool. A CRT anode cap is provided with an insulated high-voltage supply lead and an anode structure electrically connected with a free end of the insulated high-voltage lead for engagement with a CRT anode button. A conductive plate member has, in its inside portion, two parallel protrusions and formed opposite to a protrusion of a conductive plate member. With a core conductor of the high-voltage lead placed between the protrusions, the conductive plate member is pressed in the direction to engage its engaging lug with a recess of a conductive plate member.

1 Claim, 3 Drawing Sheets

CRT ANODE CAP

BACKGROUND OF THE INVENTION

The present invention relates to improvement in a CRT (cathode ray tube) anode cap which is provided with an insulated high-voltage supply lead, an anode structure electrically connected with the free end of the insulated high-voltage supply lead for engagement with a CRT anode button and an insulating cap provided at the free end of the high-voltage supply lead for housing the anode.

A CRT anode cap, in general, has an insulated high-voltage supply lead, an anode structure electrically connected with a free end of the insulated high-voltage supply lead for engagement with an anode button and a flexible insulating cap provided at the free end of a high-voltage supply lead for housing the anode structure. The insulated high-voltage supply lead is composed of a core conductor and an outer insulating coating. The insulating coating is removed at the free end of the high-voltage supply lead to expose the core conductor and the anode structure is electrically connected with the exposed portion of the core conductor. In addition, the insulating cap is provided at the free end of the high-voltage supply lead for housing the anode structure.

The anode structure has a square-shaped conductive plate member, square-shaped conductive plate members which are extend from left and right free ends portions of the conductive plate member and are folded back to the right and the left, respectively to underlie the front half-portion of the conductive plate member in opposing relation thereto, square-shaped conductive plate members which are extend downward from the rear free end portions of the conductive plate members, respectively, and conductive plate members which are extend outwardly from the front and rear end portions of the conductive plate member, respectively.

In this case, the free end portion of either of the conductive plate members extends in a manner to make sliding contact with the upper surface of the other conductive plate member, and at least the right-hand portion of either of the conductive plate members makes sliding contact with or lies adjacent to at least the left-hand portion of the other conductive plate member on the front side thereof. The conductive plate member has, in its lower left portion, an anode button engaging piece provided with a stepped portion extending outwardly to the left and a slope extending down therefrom to the right, and a flange receiving facet extending upward from the stepped portion; furthermore, the conductive plate member has a holding piece formed by bending, for example, to the front, the marginal portion extending upward from the flange receiving facet.

In this case, the opposite surfaces of the anode button engaging piece extending from the opposite surfaces of the conductive plate member, respectively, to face the front and the rear, and the stepped portion and the slope of the anode button engaging piece form a part of the periphery of the anode button engaging piece and the flange receiving facet forms a left part of the periphery of the conductive plate member.

The conductive plate member has, in its lower right portion, an anode button engaging piece provided with a stepped portion extending outwardly to the right and a slope extending down therefrom to the left, and a flange receiving facet extending upward from the stepped portion; furthermore, the conductive plate member has a holding piece formed by bending to the front the marginal portion extending upward from the flange receiving facet.

In this case, the opposite surfaces of the anode button engaging piece extending from the opposite surfaces of the conductive plate member, respectively, to face the front and the rear, and the stepped portion and the slope of the anode button engaging piece form a part of the periphery of the anode button engaging piece and the flange receiving facet forms a left part of the periphery of the conductive plate member.

The conductive plate member is formed by turning back the front free end portion of the conductive plate member at the center thereof to overlie it in opposing relation thereto and has core conductor holding pieces respectively bent down from the left-hand and right-hand free end portions of the backwardly extending portion. The conductive plate member has high-voltage supply lead holding pieces respectively bent up from its left-hand and right-hand free end portions. The anode structure of the above-mentioned construction can be obtained by punching and bending a conductive and resilient plate such as stainless steel.

The conductive plate members of the anode structure constitute an engaging portion for engagement with the CRT anode button. The conductive plate members form a radioactive-rays shielding portion for shielding radioactive rays emanating from the anode button. The conductive plate member is electrically coupled with the high-voltage supply lead, holding the exposed end portion of its core conductor by the core conductor holding pieces with a resilient force. The conductive plate member holds the high-voltage supply lead at one insulated end portion by the core conductor holding pieces with a resilient force.

The CRT anode button comprises a conductive cylindrical member, a conductive plate member extending therefrom to close the bottom opening of the cylindrical member, and a ring plate flange extending from the upper end of the cylindrical member inwardly thereof to define an opening for the cylindrical member. The CRT anode button is buried in a CRT envelope wall, with the plate member coupled with a conductive layer formed on the interior surface of the envelope wall and the cylindrical member communicating with the outside through the opening defined by the flange.

With the above-mentioned CRT anode cap, the conductive plate member of the anode structure when the latter is not engaged with the CRT anode button is biased to the left through the conductive plate member by the resiliency of the bend between the conductive plate members, and the conductive plate member is biased to the right through the conductive plate member by the resiliency of the bend between the conductive plate members.

By pressing the anode structure against the CRT anode button from the side of the insulating cap, the slope of the engaging piece of the conductive plate member and the slope of the engaging piece of the conductive plate member are urged against the open portion of the flange of the anode button to slide down into the cylindrical portion of the anode button. Namely, by the downward sliding movement, the lower left portion of the conductive plate member and the lower right portion of the conductive plate member are pressed to the right and left, respectively, against the aforementioned resiliency and the lower end portions of the both conductive plate members are inserted into the cylindrical portion of the anode button. Upon disengagement of the slopes from the open portion of the flange of the anode button, the conductive plate members are snapped back by the aforementioned resiliency to urge their flange receiving facets against the inside of the opening of the flange.

After this, the anode structure is released and fitted into the anode button. Once the anode structure is thus attached to the anode button, the anode structure is firmly held in the anode button in such a manner that their flange receiving facets are resiliently urged against the open portion wall of the flange of the anode button and their stepped portions of the engaging pieces of the conductive plate members abut against the undersurface of the flange.

The anode structure can easily be detached from the anode button by raising the former from the latter while pressing inwardly the holding pieces of the conductive plate members through the insulating cap against the aforementioned resiliency to disengage the flange receiving facets of the engaging pieces.

The CRT anode cap described above allows much ease in attaching the anode structure to the anode button as it is sufficient only to press the former toward the latter as described above and in detaching the anode structure from the anode button as it is sufficient only to bring up the former while holding it as described above. With the anode structure held on the anode button, the conductive plate members entirely cover the anode button to effectively prevent leakage of radioactive rays therefrom to the outside.

Moreover, when the anode structure is held on the anode button, the flange receiving facets of the conductive plate members are urged with a large point- or line-contact pressing force at a negligibly small contact resistance against the open portion of the flange of the anode button by virtue of the resiliency of the bends between the conductive plate members and between the conductive plate members, ensuring to achieve reliable electrical connection between the anode structure and the anode button.

The CRT anode structure of the above-mentioned prior art, wherein the insulated high-voltage supply lead must be held at its core conductor by the conductive plate member and at its insulated end portion by the conductive plate member to connect the high-voltage supply lead with the anode structure, requires making the conductive plate members firmly grasp corresponding portions of the high-voltage supply lead by using a pressing tool, for example, pliers. This assembling work is considerably hard. The high-voltage supply lead, if insufficiently held by the plate members, may easily slip out from the anode structure if the lead is forcibly pulled in the event of engaging of the anode structure with any obstruction.

SUMMARY OF THE INVENTION

It is therefore an object of the present invention to provide a CRT anode cap which is capable of easily connecting a high-voltage supply lead with an anode structure to achieve a reliable holding so that the former is not to be disconnected from the latter.

Another object of the present invention is to provide a CRT anode cap which is capable of firmly connecting a core conductor of a high-voltage supply lead with an anode structure without using any pressing tool.

Another object of the present invention is to provide a CRT anode cap which is capable of easily attaching an anode structure to an anode button by simply pressing the former into the latter.

Another object of the present invention is to provide a CRT anode cap which is capable of easily detaching an anode structure from an anode button by simply bringing up the former while holding it in a compressed state.

Another object of the present invention is to provide a CRT anode cap which is capable of effectively prevent leakage of radioactive rays from an anode button to the outside by entirely covering the anode button by conductive plate members of an anode structure when the latter is attached to the anode button.

Another object of the present invention to provide a CRT anode cap which is provided with an insulated high-voltage supply lead, an anode structure electrically connected with the free end of the insulated high-voltage supply lead for engagement with a CRT anode button, and an insulating cap provided at one end portion of the high-voltage supply lead for housing the anode structure, wherein the anode structure has a first conductive plate member, second and third conductive plate members extending from left and right free ends portions, respectively, of the first conductive plate member, fourth and fifth conductive plate members extending downwardly from the side end portions of the second and third conductive plate members respectively, to oppose to each other at their front and rear surfaces, and sixth and seventh conductive plate members extending downwardly from the front and rear end portions, respectively, of the first conductive plate member and folded inwardly to underlie the first conductive plate member. The fourth conductive plate member has, in its left portion, an anode button engaging piece provided with a stepped portion extending outwardly to the left and a slope extending down to the right inside from the left free end portion of the anode button engaging piece and a flange receiving facet extending upwardly from a right free end portion of the anode button engaging piece, the anode button engaging facet and the slope constituting a part of the periphery of the fourth conductive plate member and the flange receiving facet constituting a part of the left-side periphery of the fourth conductive plate member. The fifth conductive plate member has, in its right portion, an anode button engaging piece provided with a stepped portion extending outwardly to the right and a slope extending down to the left inside from the right free end portion of the anode button engaging piece and a flange receiving facet extending upwardly from a left free end portion of the anode button engaging piece, the anode button engaging piece and the slope constituting a part of the periphery of the fifth conductive plate member and the flange receiving facet constituting a part of the right-side periphery of the fifth conductive plate member. The fourth and fifth conductive plate members constitute an engaging portion for engaging with the CRT anode button, and the first, second and third conductive plate members constitute a radioactive-rays shielding portion for shielding radioactive rays emanating from the CRT anode button side. The sixth conductive plate member has a recess for engaging with a lug of the seventh conductive plate member, and the seventh conductive plate member has the lug formed at its front end for engaging with the recess of the sixth conductive plate member and has a through hole made therein in the vicinity of the first conductive plate member to pass therethrough a core conductor of the high-tension supply lead and a protrusion extending transversely between the hole and the engaging lug. The first conductive plate members has, in its inside portion, two parallel protrusions formed opposite to the protrusion of the seventh conductive plate member, and the core conductor of the high-voltage supply lead is sandwiched between the protrusions and the lug of the seventh conductive plate member and is engageable with the recess of the sixth conductive plate member.

BRIEF DESCRIPTION OF DRAWINGS

FIG. 1(*a*) is its perspective view from the upper left direction and FIG. 1(*b*) is its perspective view from the lower right direction.

FIG. 3(*a*) is its perspective view from the upper right direction and FIG, 3(*b*) is a perspective view from the upper right direction of the anode cap in an upside down position relative to the FIG. 3(*a*) position.

PREFERRED EMBODIMENTS OF THE INVENTION

Figure 1A:
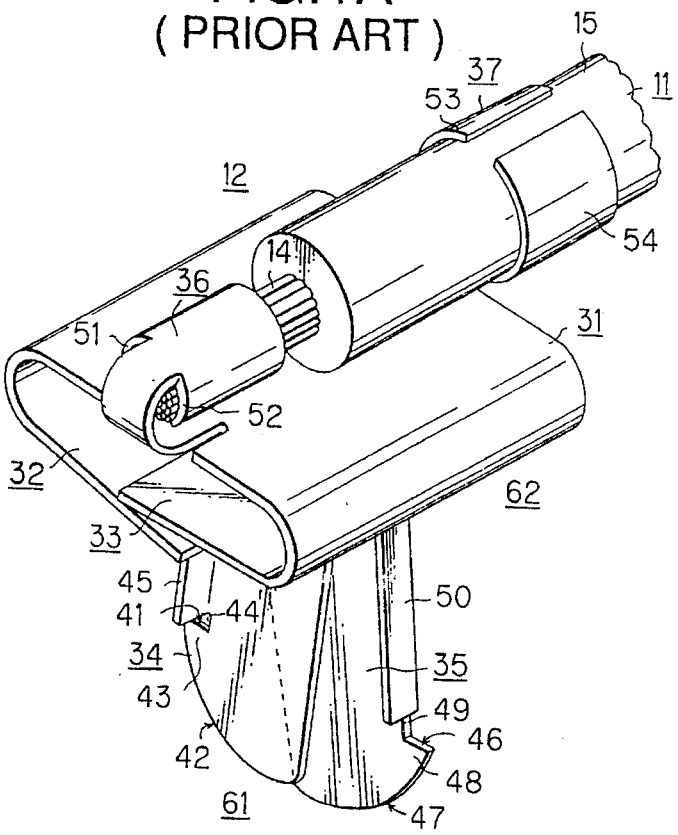
FIG.1A ( PRIOR ART )
FIGS. 1*a* and 1*b* are perspective views for explaining an example of a conventional CRT anode cap.
Figure 1B:
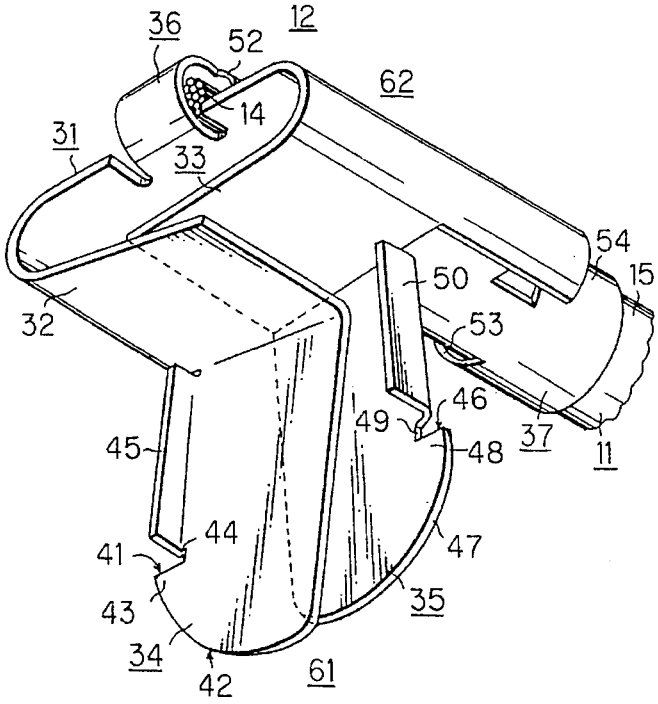
FIG.1B ( PRIOR ART )

FIGS. 1*a* and 1*b* are perspective views for explaining an example of a conventional CRT anode cap. FIGS. 1(*a*) and 1(*b*) are views from the upper right and the lower right directions respectively. The CRT anode cap of FIGS. 1*a* and 1*b* has an insulated high-voltage supply lead 11, an anode structure 12 electrically connected with a free end of the insulated high-voltage supply lead for engagement with an anode button and a flexible insulating cap (not shown) provided at the free end of a high-voltage supply lead 11 for housing the anode structure 12. In the drawing, the insulated high-voltage supply lead 11 is composed of a core conductor 14 and an outer insulating coating 15. The insulating coating 15 is removed at the free end of the high-voltage supply lead 11 to expose the core conductor 14, and the anode structure 12 is electrically connected with the exposed portion of the core conductor 14. In addition, the insulating cap 13 (see FIG. 2) is provided at the free end of the high-voltage supply lead 11 for housing the anode structure 12.

As is apparent from FIGS. 1(*a*) and 1(*b*), the anode structure 12 has a square-shaped conductive plate member 31, square-shaped conductive plate members 32 and 33 which extend from left and right free ends portions of the conductive plate member 31 and are folded back to the right and the left, respectively to underlie the front half-portion of the conductive plate member 31 in opposing relation thereto, square-shaped conductive plate members 34 and 35 which extend downward from the rear free end portions of the conductive plate members 32 and 33, respectively, and conductive plate members 36 and 37 which extend outwardly from the front and rear end portions of the conductive plate member 31, respectively.

In this case, the free end portion of either of the conductive plate members 32 and 33 (for example, 33) extends in a manner to make sliding contact with the upper surface of the other conductive plate member 32, and at least the right-hand portion of either of the conductive plate members 34 and 35 (for example, 34) makes sliding contact with or lies adjacent to at least the left-hand portion of the other conductive plate member 35 on the front side thereof. The conductive plate member 34 has, in its lower left portion, an anode button engaging piece 43 provided with a stepped portion 41 extending outwardly to the left and a slope 42 extending down therefrom to the right, and a flange receiving facet 44 extending upward from the stepped portion 41. Furthermore, the conductive plate member 34 has a holding piece 45 formed by bending, for example, to the front, the marginal portion extending upward from the flange receiving facet 44.

In this case, the opposite surfaces of the anode button engaging piece 43 extending from the opposite surfaces of the conductive plate member 34, respectively, to face the front and the rear, and the stepped portion 41 and the slope 42 of the anode button engaging piece 43 form a part of the periphery of the anode button engaging piece 43 and the flange receiving facet 44 forms a left part of the periphery of the conductive plate member 43.

The conductive plate member 35 has, in its lower right portion, an anode button engaging piece 48 provided with a stepped portion 46 extending outwardly to the right and a slope 47 extending down therefrom to the left, and a flange receiving facet 49 extending upward from the stepped portion 46. Furthermore, the conductive plate member 35 has a holding piece 50 formed by bending to the front the marginal portion extending upward from the flange receiving facet 49.

In this case, the opposite surfaces of the anode button engaging piece 48 extending from the opposite surfaces of the conductive plate member 35, respectively, to face the front and the rear, and the stepped portion 46 and the slope 47 of the anode button engaging piece 48 form a part of the periphery of the anode button engaging piece 48 and the flange receiving facet 49 forms a left part of the periphery of the conductive plate member 35.

The conductive plate member 36 is formed by turning back the front free end portion of the conductive plate member 31 at the center thereof to overlie it in opposing relation thereto and has core conductor holding pieces 51 and 52 respectively bent down from the left-hand and right-hand free end portions of the backwardly extending portion. The conductive plate member 37 has high-voltage supply lead holding pieces 52 and 54 respectively bent up from its left-hand and right-hand free end portions. The anode structure 12 of the above-mentioned construction can be obtained by punching and bending a conductive and resilient plate such as stainless steel.

The conductive plate members 34 and 35 of the anode structure 12 constitute an engaging portion 61 for engagement with the CRT anode button. The conductive plate members 31, 32 and 33 form a radioactive-rays shielding portion 62 for shielding radioactive rays emanating from the anode button. The conductive plate member 36 is electrically coupled with the high-voltage supply lead, holding the exposed end portion of its core conductor 14 by the core conductor holding pieces 51 and 52 with a resilient force. The conductive plate member 37 holds the high-voltage supply lead 11 at one insulated end portion by the core conductor holding pieces 53 and 54 with a resilient force.

Figure 2:
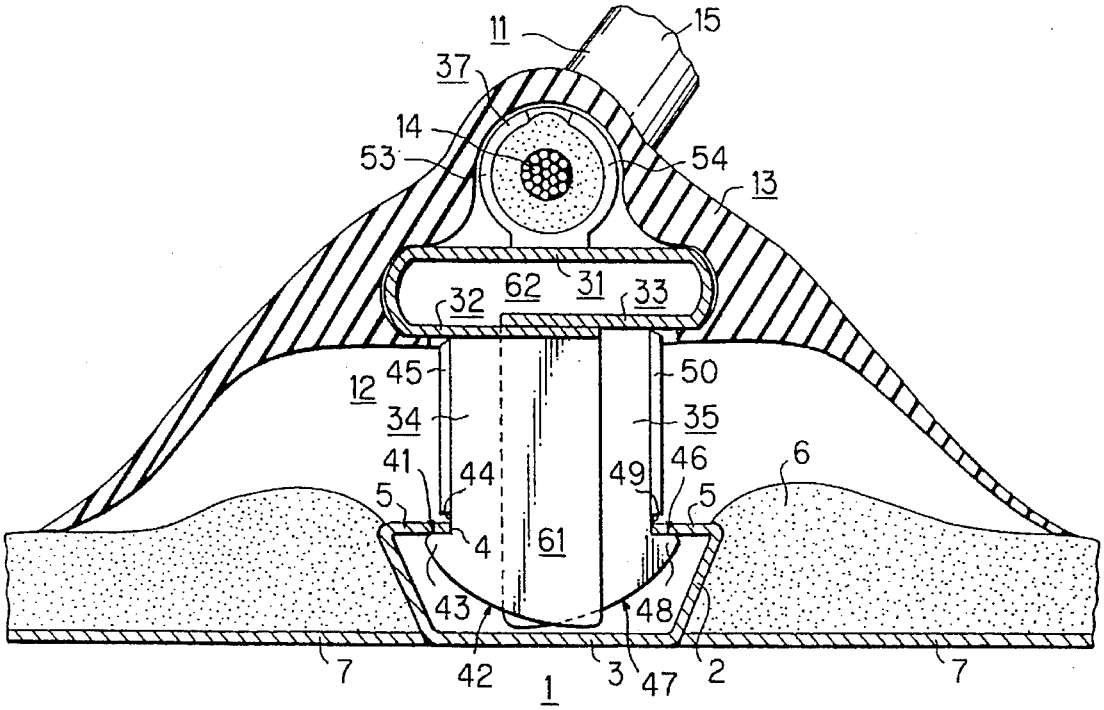
FIG.2 ( PRIOR ART )
FIG. 2 is a view for explaining the operating state of the conventional CRT anode cap.

FIG. 2 is a view for explaining an example of a CRT anode button to which the above-mentioned CRT anode cap is attached. The CRT anode cap denoted by numeral 1 comprises a conductive cylindrical member 2, a conductive plate member 3 extending therefrom to close the bottom opening of the cylindrical member 2, a ring plate flange 5 extending from the upper end of the cylindrical member 2 inwardly thereof to define an opening 4 for the cylindrical member 2. The CRT anode button 1 is buried in a CRT envelope wall 6, with the plate member 3 coupled with a conductive layer 7 formed on the interior surface of the envelope wall 6 and the cylindrical member 2 communicating with the outside through the opening 4 defined by the flange 5.

With the above-mentioned CRT anode cap, the conductive plate member 34 of the anode structure 12 when the latter is not engaged with the CRT anode button 1 is biased to the left through the conductive plate member 32 by the resiliency of the bend between the conductive plate members 31 and 32 and the conductive plate member 35 is biased to the right through the conductive plate member 33 by the resiliency of the bend between the conductive plate members 31 and 33.

By pressing the anode structure 12 against the CRT anode button 1 from the side of the insulating cap 13, the slope 42 of the engaging piece 43 of the conductive plate member 34 and the slope 47 of the engaging piece 48 of the conductive plate member 35 are urged against the open portion 4 of the flange 5 of the anode button 1 to slide down into the cylindrical portion 2 of the anode button 1. Namely, by the downward sliding movement, the lower left portion of the conductive plate member 34 and the lower right portion of the conductive plate member 35 are pressed to the right and left, respectively, against the aforementioned resiliency and the lower end portions of the both conductive plate members 34 and 35 are inserted into the cylindrical portion 2 of the anode button 1. Upon disengagement of the slopes 42 and 47 from the open portion 4 of the flange 5 of the anode button 1, the conductive plate members 34 and 35 are snapped back by the aforementioned resiliency to urge their flange receiving facets 44 and 49 against the inside of the opening 4 of the flange 5.

After this, the anode structure 12 is released and fitted into the anode button 1. Once the anode structure 12 is thus attached to the anode button 1, the anode structure 12 is firmly held in the anode button 1 in such a manner that their flange receiving facets 44 and 49 are resiliently urged against the open portion wall 4 of the flange 5 of the anode button 1 and their stepped portions 41 and 46 of the engaging pieces 43 and 48 of the conductive plate members 34 and 35 abut against the undersurface of the flange 5.

The anode structure 12 can easily be detached from the anode button 1 by raising the former from the latter while pressing inwardly the holding pieces 45 and 50 of the conductive plate members 34 and 35 through the insulating cap 13 against the aforementioned resiliency to disengage the flange receiving facets 44 and 49 of the engaging pieces 43 and 48.

The CRT anode cap described above allows much ease in attaching the anode structure 12 to the anode button 1 as it is sufficient only to press the former toward the latter as described above and in detaching the anode structure 12 from the anode button 1 as it is sufficient only to bring up the former while holding it as described above. With the anode structure 12 held on the anode button 1, the conductive plate members 31, 32 and 33 entirely cover the anode button 1 to effectively prevent leakage of radioactive rays therefrom to the outside.

Moreover, when the anode structure 12 is held on the anode button 1, the flange receiving facets 44 and 49 of the conductive plate members 34 and 35 are urged with a large point- or line-contact pressing force at a negligibly small contact resistance against the open portion 4 of the flange 5 of the anode button 1 by virtue of the resiliency of the bends between the conductive plate members 31 and 21 and between the conductive plate members 31 and 32, ensuring a reliable electrical connection between the anode structure 12 and the anode button 1.

The CRT anode structure of the above-mentioned prior art, wherein the insulated high-voltage supply lead 11 must be held at its core conductor by the conductive plate member 36 and at its insulated (covered) end portion by the conductive plate member 37 to connect the high-voltage supply lead 11 with the anode structure 12, requires making the conductive plate members 36 and 37 firmly grasp corresponding portions of the high-voltage supply lead 11 by using a pressing tool, for example, pliers. This assembling work is considerably hard. The high-voltage supply lead 11, if be insufficiently held by the plate members 34 and 35, may easily slip out from the anode structure if the lead is forcibly pulled in the event of engaging of the anode structure with any obstruction.

Figure 3A:
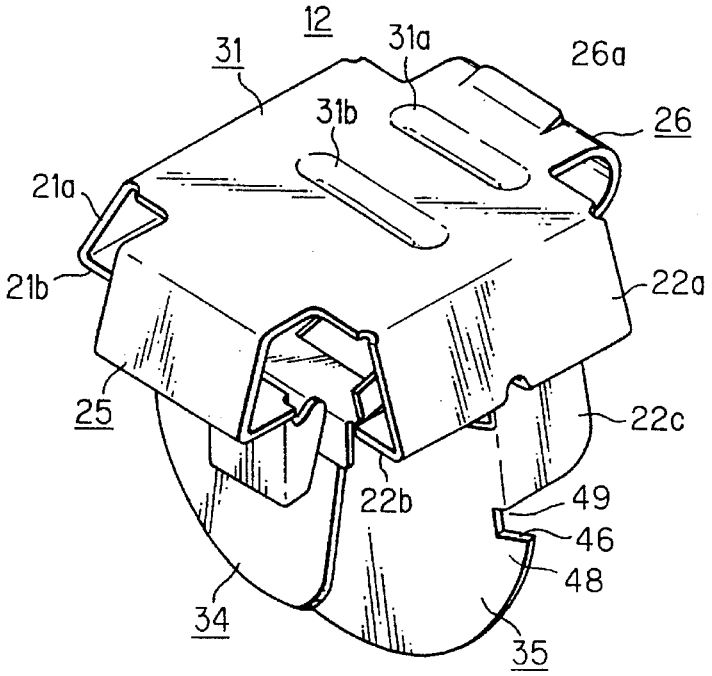
FIGS. 3*a* and 3*b* are perspective views for explaining an embodiment of a CRT anode cap according to the present invention.
Figure 3B:
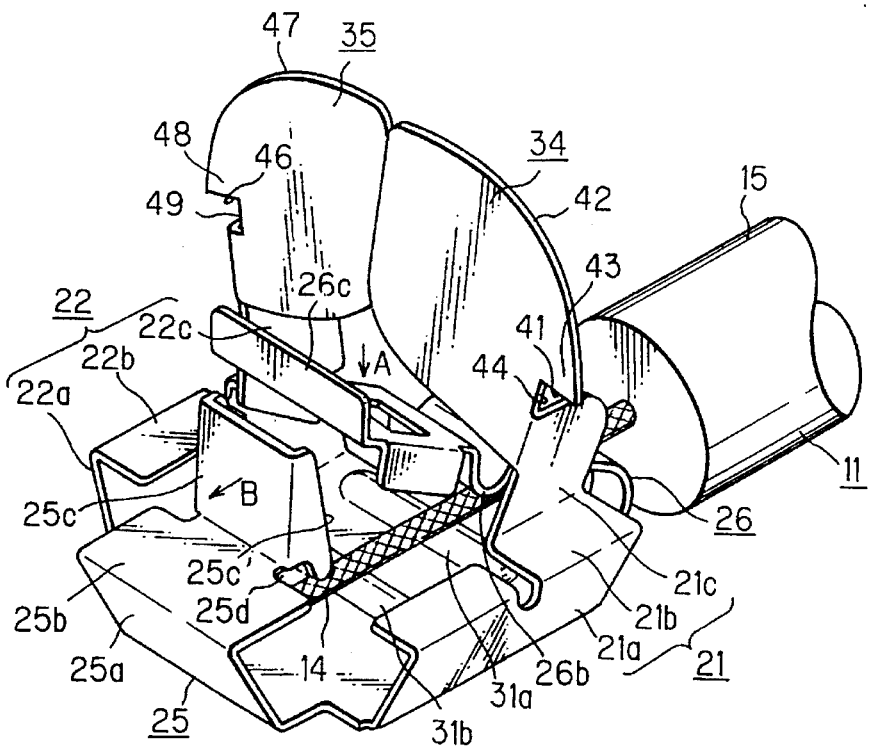

FIGS. 3*a* and 3*b* are perspective views for explaining an embodiment of a CRT anode cap according to the present invention. FIG. 3(*a*) is its perspective view from the upper right direction. FIG. 3(*b*) is a perspective view from the upper right direction of the anode cap in an upside down position relative to the FIG. 3(*a*) position and having a high-voltage lead coupled with its anode structure. Parts similar to those of the prior art device shown in FIGS. 1*a* and 1*b* are designated by the same reference numerals in FIGS. 3(*a*) and 3(*b*).

According to the present invention, it is possible to firmly connect a core conductor of a high-voltage supply lead with a CRT anode structure without using a pressing tool when attaching the high-voltage supply lead to the CRT anode structure.

As shown in FIGS. 3*a* and 3*b*, in the CRT anode cap according to the present invention, a first conductive plate member 31 has first bent plate portions 21*a* and 22*a* extending downwardly from the left and right free end portions thereof, second bent plate portions 21*b* and 22*b* extending inwardly from the end portions of the first left and right bent plate portion 21*a* and 22*a* to underlie the conductive plate member 31, and third bent plate portions 21*c* and 22*c* extending downwardly from the end portions of the second left and right bent plate portions 21*b* and 22*b*. A fourth and fifth conductive plate members 34 and 35 are formed by bending the left and right free-end portions of the third bent plates 21*c* and 22*c*, respectively, to oppose at their peripheral surfaces to the conductive plate member 31.

In other words, the bent plate portions 21*a*, 21*b*, 21*c* constitute a first side (e.g., left) plate portion 21 extending from the first conductive plate member 31 shown in FIGS. 1*a* and 1*b* and the bent plate portions 22*a*, 22*b* and 22*c* constitute a first side (e.g., right) plate portion 22 thereof. These bent plate portions in terms of their functions correspond to the second and third conductive plate members 34 and 35 shown in FIGS. 1*a* and 1*b* which connect the anode button 1 with the first conductive plate member 31 by the anode button engaging pieces 43 and 48 and the holding pieces 45 and 50. Namely, the first and second side plates 21 and 22 serve as connecting plates for resiliently connecting the first conductive plate member 31 with the fourth conductive plate member 34 and the fifth conductive plate member 35 respectively, and they also work as holding plate pieces (45 and 50 of FIGS. 1*a* and 1*b*) when detaching the fourth and fifth conductive plate members from the anode button 1.

By pressing an anode structure 12 against the anode button from the side of an insulating cap, slopes 42 and 47 of conductive plate members 34 and 35 for engaging anode structure 12 with the anode button are urged against the flange 5 of the anode button 1 to slide down into an opening 4 defined by the flange 5. Namely, by the downward sliding movement, the lower left portion of the conductive plate member 34 and the lower right portion of the conductive plate member 35 are pressed to the right and the left, respectively, against the aforementioned resiliency and the lower end portions of the both conductive plate members 34 and 35 are inserted into a cylindrical portion 2 of the anode button 1. Upon disengagement of the slopes 42 and 47 from the flange 5 of the anode button 1, the conductive plate members 34 and 35 are snapped back to urge their flange receiving facets 44 and 49 against the inside wall of the open portion 4 of the flange 5.

After this, the anode structure 12 is released and fitted into the anode button 1. Once the anode structure 12 is thus attached to the anode button 1, the anode structure 12 is firmly held in the anode button 1 in such a manner that their flange receiving facets 44 and 49 are resiliently urged against the inside wall of the open portion 4 of the flange 5 of the anode button 1 and their engaging pieces 41 and 46 abut against the undersurface of the flange 5.

The anode structure 12 can be detached from the anode button 1 by raising the former from the latter while pressing inwardly the second bent plate portion 21*b* of the left-hand plate member 21 and the second bent plate portion 22*b* of the right-hand plate member 22 through the insulating cap against the aforementioned resiliency to disengage the engaging pieces 41 and 46 of the conductive plate members 34 and 35 from the flange 6 of the anode button.

In this specification, the first side plate 21 (21*a*, 21*b*, 21*c*) and the second side plate 22 (22*a*, 22*b*, 22*c*) are hereinafter referred to as second and third conductive plate members respectively.

The fourth and fifth conductive plate members 34 and 35 can be attached to or detached from the anode button 1 in the above-described manner and their engaging pieces 41, 46, slopes 42, 47 and flange receiving facets 44, 49 work in the same way as those of the prior art device of FIGS. 1*a* and 1*b*.

Bent plate portions 25 and 26 of the first conductive plate member 31 are an example of a connecting mechanism for connecting a high-voltage supply lead 11 with the anode structure 12 and are hereinafter referred to as sixth (25) and seventh (26) conductive plate members respectively. The sixth conductive plate member 25 and the seventh conductive plate member 26 co-operate with each other in connecting a core conductor 14 of the high-voltage supply lead 11 with the anode structure 12. The first conductive plate member 31 is provided with two linear protrusions 31*a* and 31*b* extending transversely (from the left to the right) and downwardly. The seventh conductive plate member 26 has a hole 26*a* for inserting therethrough the core conductor 14 of the high-voltage supply lead 11.

By inserting the core conductor 14 of the high-voltage supply lead 11 through the hole 26*a* made in the seventh conductive plate member 26 (as shown in FIG. 3B) and pressing the conductive plate member 26 in the direction indicated by an arrow A, its engaging lug 26*c* comes into engagement with an engaging recess 25*d* and hence protrusions 31*a* and 31*b* of the first conductive plate member 31 and a protrusion 26*b* of the seventh plate member 26 firmly hold therebetween the core conductor 14 of the high-voltage supply lead 11 not to allow the high-voltage supply lead 11 to slip out from the anode structure 12. Namely, the seventh conductive plate member 26 is provided with the protrusion 26*b* formed thereon to oppositely locate between the two parallel protrusions formed on the conductive plate member 31, and the core conductor 14 of the high-voltage supply lead 11 can be firmly grasped between these protrusions 26*b*, 31*a*, 31*b* when the seventh conductive plate members 26 is pressed down in the direction shown by the arrow A. Once the high-voltage supply lead 11 is thus connected with the anode structure 12, it can not be pulled out therefrom.

The sixth conductive plate member 25 consists of a first conductive plate portion 25*a* extending downwardly from the first conductive plate member 31, a second conductive plate portion 25*b* extending toward the anode structure from the conductive plate portion 25*a* and a third conductive plate portion 25*c* extending downwardly from the first conductive plate portion 25*a*. The front end portion of the third conductive plate portion 25*c* projects upwardly (downwardly in case of FIG. 3B), forming a slope 25*c* toward the anode structure side. By pressing the seventh conductive plate member 26 in the direction indicated by the arrow A, the engaging lug 26*c* of the seventh conductive plate member 26 urges the slope 25*c*' to move back against the resiliency of the conductive plate member 25 in the direction indicated by an arrow B until the engaging lug 26*c* of the seventh conductive plate member 26 enters into the engagement with the engaging recess 25*d* of the sixth conductive plate member 25 to connect the high-voltage supply lead 11 with the anode structure 12.

The high-voltage supply lead 11 can be easily detached from the anode structure 12 by pulling the third conductive plate portion 25*c* of the sixth conductive plate member 25 in the direction indicated by the arrow A. By doing so, the engaging lug 26*c* of the seventh conductive plate member 26 disengages from the engaging recess 25*d* of the sixth conductive plate member to release the high-voltage supply lead 11 from the anode structure.

The CRT anode cap described above allows much ease in attaching the anode structure 12 to the anode button 1 as it is sufficient only to press the former toward the latter as described above and in detaching the anode structure 12 from the anode button 1, it is sufficient only to bring up the former while holding it as described above. Furthermore, when the anode structure 12 is held on the anode button 1, the conductive plate members 31, 25 and 26 entirely cover the anode button 1 to effectively prevent leakage of radioactive rays therefrom to the outside.

Moreover, when the anode structure 12 is held on the anode button 1, the flange receiving facets 44 and 49 of the conductive plate members 34 and 35 are urged with a large point- or line-contact pressing force at a negligibly small contact resistance against the open portion 4 of the flange 5 of the anode button 1 by virtue of the resiliency of the bends between the conductive plate members 31 and 21 and between the conductive plate members 31 and 22, ensuring reliable electrical connection between the anode structure 12 and the anode button 1. Furthermore, the CRT anode cap according to the present invention allows easy connection of the high-voltage supply lead 11 with the anode structure 12 without using any assembling tool, assuring reliable holding of the high-voltage supply lead 11 to the anode structure 12.

We claim:

1. A CRT anode cap which is provided with an insulated high-voltage supply lead, an anode structure electrically connected with the free end of the insulated high-voltage supply lead for engagement with a CRT anode button, and an insulating cap provided at one end portion of the high-voltage supply lead for housing the anode structure, said anode structure having a first conductive plate member having left and right free end portions and front and rear end positions, second and third conductive plate members extending from said left and right free end portions, respectively, of the first conductive plate member, said second and third conductive plate members having side end portions, said anode structure further having fourth and fifth conductive plate members extending downwardly from said side end portions of the second and third conductive plate members, respectively, to oppose to each other at their front and rear surfaces, sixth and seventh conductive plate members extending downwardly from said front and rear end portions, respectively, of the first conductive plate member and folded inwardly to underlie the first conductive plate member, said fourth conductive plate member having a left portion, said fourth conductive plate member having a first anode button engaging piece provided with a right free end portion and a stepped portion extending outwardly to the left and a slope extending down therefrom to the right and a flange receiving facet extending upwardly from said right free end portion of said first anode button engaging piece, said first anode button engaging piece and said slope constituting a part of a peripheral surface of the fourth conductive plate member and said flange receiving facet constituting a part of a left-side peripheral surface of the fourth conductive plate member said fifth conductive plate member having a right portion and a second anode button engaging piece provided in said right portion of said fifth conductive plate, said second anode button engaging piece having a left free end portion and a stepped portion extending outwardly to the right and a slope extending down therefrom to the left and a flange receiving facet extending upwardly from said left free end portion of said second anode button engaging piece, said second anode button engaging piece and said slope constituting a part of a peripheral surface of the fifth conductive plate member and said flange receiving facet constituting a part of a right-side peripheral surface of the fifth conductive plate member, said fourth and fifth conductive plate members constituting an engaging portion for engaging the CRT anode button, said first, second and third conductive plate members constituting a radioactive ray shielding portion for shielding radioactive rays emanating from the CRT anode button, said seventh conductive plate member having a front end and a lug formed at said front end, said sixth conductive plate member having a recess for engagement with said lug of the seventh conductive plate member, said seventh plate member having a through hole made therein in the vicinity of the first conductive plate member to pass therethrough a core conductor of the high-voltage supply lead and a protrusion extending transversely between the hole and the engaging lug, said first conductive plate members having an inside portion and two parallel protrusions formed in said inside portion opposite to the protrusion of the seventh conductive plate member, said core conductor of the high-voltage supply lead being sandwiched between the protrusions and the lug of the seventh conductive plate member which is engageable with the recess of the sixth conductive plate member.

* * * * *